US008460023B2

(12) United States Patent
Someya

(10) Patent No.: US 8,460,023 B2
(45) Date of Patent: Jun. 11, 2013

(54) WATERPROOF STRUCTURE FOR A CABLE CONNECTOR, AND A PLUG CONNECTOR, SOCKET CONNECTOR AND CABLE CONNECTOR UTILIZING THE SAME

(75) Inventor: Toshiyuki Someya, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 17 days.

(21) Appl. No.: 13/155,071

(22) Filed: Jun. 7, 2011

(65) Prior Publication Data

US 2011/0300730 A1 Dec. 8, 2011

(30) Foreign Application Priority Data

Jun. 8, 2010 (JP) ..... 2010-131124

(51) Int. Cl.
*H01R 13/52* (2006.01)

(52) U.S. Cl.
USPC ..... 439/275; 439/587

(58) Field of Classification Search
USPC ..... 439/271, 274, 275, 277, 279, 587, 439/660
See application file for complete search history.

(56) References Cited

U.S. PATENT DOCUMENTS

| | | | | |
|---|---|---|---|---|
| 5,795,173 | A * | 8/1998 | Werner et al. | 439/275 |
| 6,361,342 | B1 * | 3/2002 | Cox | 439/275 |
| 6,608,960 | B2 * | 8/2003 | Cairns et al. | 385/138 |
| 6,676,447 | B1 * | 1/2004 | Knox | 439/587 |
| 7,789,689 | B2 * | 9/2010 | Frey et al. | 439/275 |
| 8,007,302 | B2 * | 8/2011 | Kleinke | 439/275 |

FOREIGN PATENT DOCUMENTS

| | | |
|---|---|---|
| JP | 05-034672 | 5/1993 |
| JP | 2002-298656 | 10/2002 |

OTHER PUBLICATIONS

Decision to Grant issued in corresponding Japanese Patent Application No. 2010-131124, dated Aug. 26, 2011 (3 pages including 1 page of communication and 2 pages of translation.).

* cited by examiner

*Primary Examiner* — Thanh Tam Le
(74) *Attorney, Agent, or Firm* — Finnegan, Henderson, Farabow, Garrett & Dunner, LLP

(57) ABSTRACT

In the case where the cable CA is passed through the hole of the sealing tube and connected to the plug contact terminal and the socket contact terminal, when the female threaded portions and of the stepped pressure nut members and are respectively screwed onto the male threaded portions and of the plug housing and the socket housing, the outer periphery of the cable CA inside the plug housing and the socket housing is sealed by way of the pressing pieces and the sealing tube being pressed.

8 Claims, 12 Drawing Sheets

WATERPROOF STRUCTURE FOR A CABLE CONNECTOR, AND A PLUG CONNECTOR, SOCKET CONNECTOR AND CABLE CONNECTOR UTILIZING THE SAME

CROSS-REFERENCES TO THE RELATED APPLICATIONS

This application claims the benefit of Japanese Patent Application No. 2010-131124 filed Jun. 8, 2010, which is hereby incorporated by reference herein in its entirety.

BACKGROUND OF THE INVENTION

1. Field of the Invention

The present invention relates to a waterproof structure for a cable connector, and a plug connector, socket connector and cable connector utilizing the same.

2. Description of the Related Art

Waterproof cable connectors have generally been made available for practice that electrically connect between photovoltaic modules or between a solar power generation module and a power switchboard. These types of cable connectors, as shown in Japanese Patent Laid-open No. 2002-298656 for example, are configured to include a male terminal fitting as a contact terminal, a sealing tube that covers the wire crimping portion of the male terminal fitting and the insulating jacketing of the cable, and a housing joined to an end of the cable by molding.

An end of a cylindrical sealing tube, formed from a heat-shrinkable synthetic resin, is bonded to the distal end of the insulating jacketing of the cable, and the other end of the sealing tube is bonded to the wire crimping portion of the male terminal fitting. Herewith the distal end of the insulating jacketing of the cable and the wire crimping portion of the male terminal fitting are sealed by the sealing tube.

Furthermore, the distal end of the insulating jacketing of the cable and the wire crimping portion of the male terminal fitting sealed by the sealing tube are embedded into the above described housing by way of molding. Thus it is possible to prevent outside liquid such as rainwater from making an entry through the insulating jacketing of the cable into the male terminal fitting and the wire crimping portion inside the housing.

SUMMARY OF THE INVENTION

When performing installation of photovoltaic modules using a cable connector such as that described above, for example, a subassembly, which comprises the above described connector connected to the end of a cable set to a prescribed length, is prepared in advance, and the installation is carried out.

However, upon installation, there are unavoidable cases where the length of necessary cable must be changed, due to, for example, a change of the installation position of the photovoltaic modules at the site. In this case, with the above described cable connectors, it is necessary to manufacture a subassembly comprising the above described connector connected to an end of a cable having a changed length by molding. Thus, because of the difficulty of manufacturing, at the site, a subassembly wherein the above described connector is connected to the end of a cable, a problem occurs wherein installation must be suspended until the new cable can be prepared.

In view of the above-described mentioned problem, the present invention aims to provide a waterproof structure for a cable connector, and a plug connector, socket connector and cable connector that uses the same. The waterproof structure for a cable connector, and a plug connector, socket connector and cable connector that uses the same can easily attach a cable connector to one end of a cable without the need for molding while at the same time reliably preventing the penetration of liquid inside the cable connector.

In order to achieve the above described object, a waterproof structure for a cable connector of the present invention comprises a housing that detachably houses a contact terminal connected to an end of a cable; a housing that detachably houses a contact terminal connected to an end of a cable; a sealing cylinder that is disposed in the housing and holds, inside a plurality of pressing pieces, a sealing tube mounted on the outer periphery of the cable inserted into the housing; and a pressing member that presses the plurality of pressing pieces of the sealing cylinder, and the sealing tube, toward the outer periphery of the cable inside the housing, when the contact terminal connected to the end of the cable is housed in the housing; wherein engagement nibs, respectively formed on at least one pair of pressing pieces among the plurality of pressing pieces of the sealing cylinder, movably engage the pressing member.

Furthermore, in a waterproof structure for a cable connector of the invention, protrusions, which protrude toward the inner periphery of the pressing member, may be formed on each pressing piece of the sealing cylinder, and projections, which press the protrusions of each of the pressing pieces, may be formed on the inner periphery of the pressing member.

Furthermore, a plug connector of the present invention comprises a plug housing that detachably houses a plug contact terminal, which is connected to an end of a cable and has a rod-shaped contact end; a sealing tube mounted on the outer periphery of the cable inserted into the plug housing; a sealing cylinder that is disposed in the plug housing and holds the sealing tube inside a plurality of pressing pieces; and a pressing member that presses the plurality of pressing pieces of the sealing cylinder, and the sealing tube, toward the outer periphery of the cable inside the plug housing, when the plug contact terminal connected to the end of the cable is housed in the plug housing; wherein engagement nibs, respectively formed on at least one pair of pressing pieces among the plurality of pressing pieces of the sealing cylinder, movably engage the pressing member.

Furthermore, a socket connector of the present invention comprises a socket housing that detachably houses a socket contact terminal, which is connected to an end of a cable and has a cylindrical contact end; a sealing tube mounted on the outer periphery of the cable inserted into the socket housing; a sealing cylinder that is disposed in the socket housing and holds the sealing tube inside a plurality of pressing pieces; and a pressing member that presses the plurality of pressing pieces of the sealing cylinder, and the sealing tube, toward the outer periphery of the cable inside the socket housing, when the socket contact terminal connected to the end of the cable is housed in the socket housing; wherein engagement nibs, respectively formed on at least one pair of pressing pieces among the plurality of pressing pieces of the sealing cylinder, movably engage the pressing member.

A cable connector of the present invention is configured to comprise the plug connector and socket connector described above.

According to the waterproof structure for a connector cable of the present invention, and a plug connector, socket connector and cable connector utilizing the same, it is possible to easily attach a cable connector to the end of a cable without the need for molding because the housing detachably houses the contact terminal to which the end of the cable is attached.

Furthermore, because a sealing cylinder is provided that holds a sealing tube, mounted on the outside of the cable inserted into the housing, inside a plurality of pressing pieces, and a pressing member presses, in the case where the contact terminal having an end of the cable connected thereto is received in the housing, the plurality of pressing pieces of the sealing cylinder, along with the sealing tube, towards the outer periphery of the cable inside the housing, it is possible to reliably prevent the penetration of liquid inside the cable connector.

Further features of the present invention will become apparent from the following description of exemplary embodiments with reference to the attached drawings.

DESCRIPTION OF THE EMBODIMENTS

Figure 2:
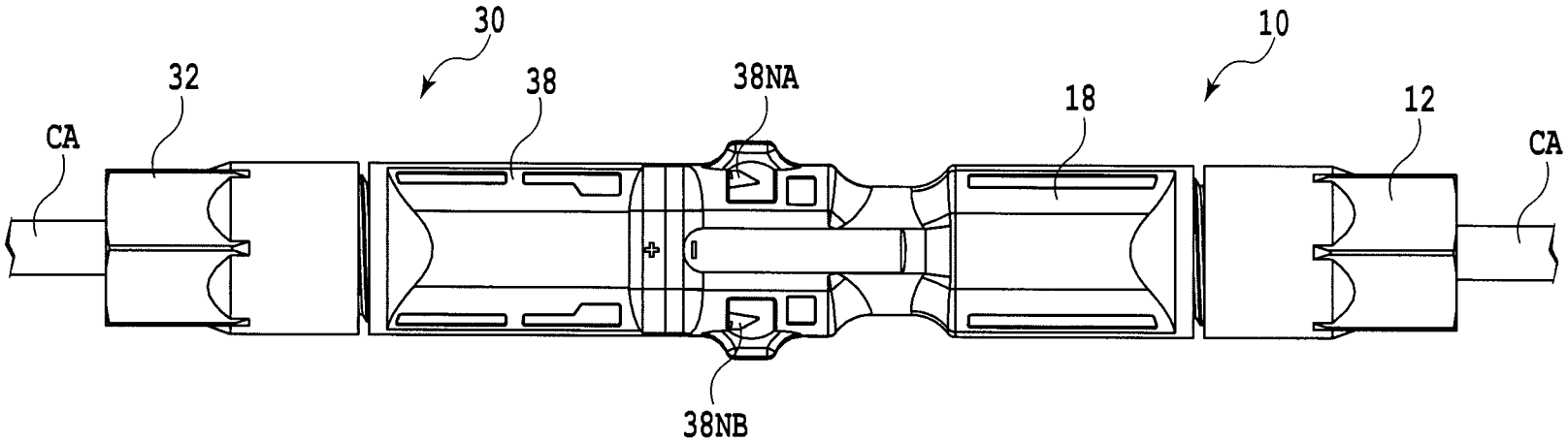
FIG. 2 is a front view illustrating the cable connector shown in FIG. 1, in a connected state.

FIG. 2 illustrates an external view of a cable connector that utilizes an example of a waterproof structure for a cable connector according to the present invention. Regarding the cable connector, it should be noted that in FIG. 2 the later described socket connector and plug connector are shown in a connected state.

The cable connector shown in FIG. 2 is to be attached, for example, to both ends of a cable that mutually connects photovoltaic modules, to the ends of a cable that connects between a photovoltaic module and a power switchboard, or to the ends of a cable that connects between a free hanging type connector and a photovoltaic module.

In FIG. 2 the cable CA is, for example, a cable for connecting solar modules (Model KSK-, manufactured by Kaneko Cord Co.), comprising a single-core internal conductor, a cross-linked polyethylene insulator that clads the internal conductor, and a flame resistant cross-linked polyethylene sheath that sheathes the internal conductor and the cross-linked polyethylene insulator. The burning-resistance cross-linked polyethylene sheath has an outer diameter, for example, on the order of 7 mm. The internal conductor has an outer diameter, for example, on the order of 2 to 3 mm.

Figure 3:
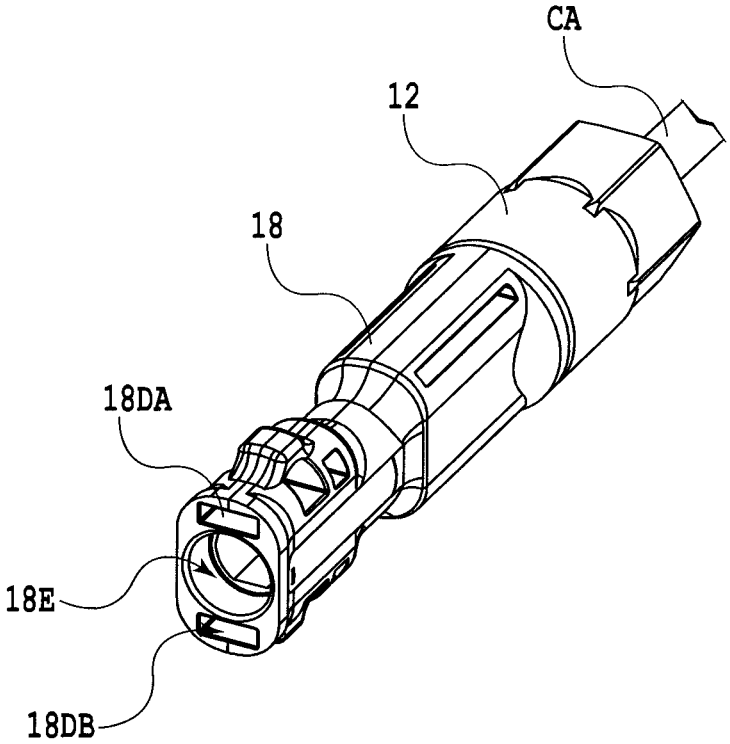
FIG. 3 is a perspective view illustrating a plug connector that makes up one part of the example shown in FIG. 1.

In FIG. 2 the plug connector 10 and the socket connector 30 are detachably connected to each other. The plug connector 10, as shown in FIG. 3 and FIG. 5, is configured such that it includes as main components a plug contact terminal 20 that connects to the inner conductor of one end of the cable CA, a cylindrical shaped cylinder 14 for contacting/sealing having a through hole for one end of the cable CA to be inserted, which holds the plug contact terminal 20, a tube 16 for sealing between the outer periphery of one end of the cable CA and the inner periphery of the contacting/sealing cylinder 14, a plug housing 18 that houses the plug contact terminal 20 and the contact/sealing cylinder 14 in which the sealing tube 16 is inserted into the inner part thereof, and a stepped pressure nut member 12 that has a female threaded portion 12FS that is threaded into the male threaded portion 18MS of the plug housing 18, and which presses the pressing pieces 14Pi of the contact/sealing cylinder 14 towards the sealing tube 16.

Figure 1:
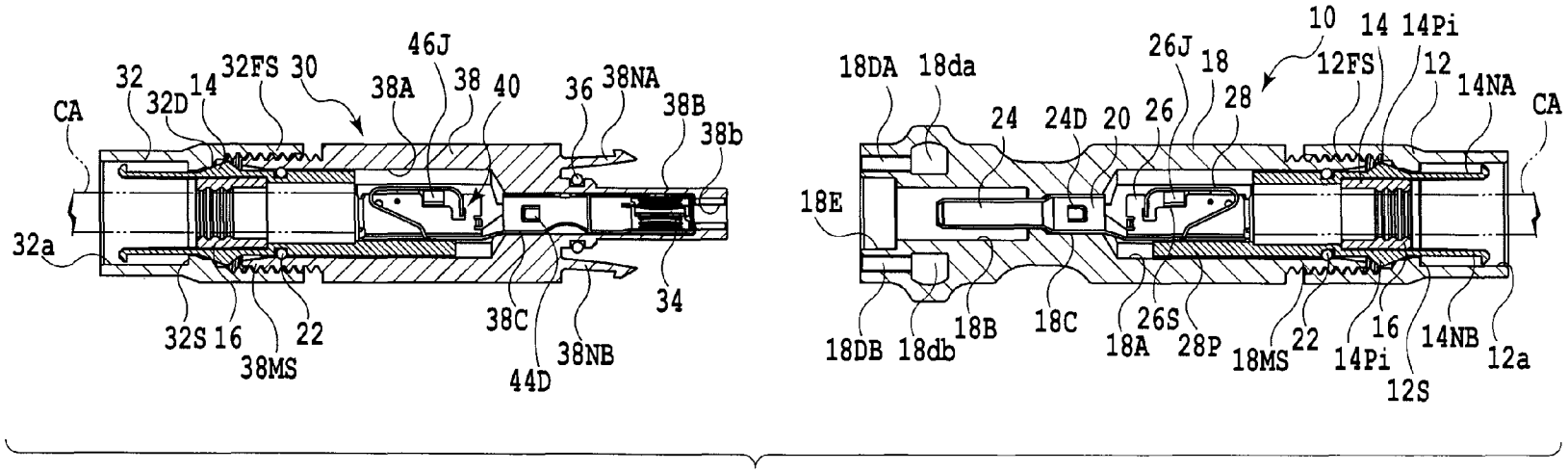
FIG. 1 is a cross sectional view illustrating a disassembled cable connector that utilizes an example of a waterproof structure for a cable connector according to the present invention.

The plug contact terminal 20, as shown in FIG. 1, is integrally formed by press working with thin metal sheet material, for example, and is configured to include a tubular bar-shaped contact end 24 fitted into the hole 44*a* of the cylindrical shaped contact end 44 of the later described socket contact terminal 40, and to include a conductor connecting portion 26 that, as described later, selectively presses and connects the inner conductor of one end of the cable CA. A projection 24D, which engages with a concave portion (unshown) formed on the communication portion 18C of the plug housing 18 described later, is formed on the contact end 24. Due to this, when the contact end 24 of the plug contact terminal 20 is inserted into the communication portion 18C, its position with respect to the communication portion 18C of the plug contact terminal 20 is positioned by way of the projection engaging the concave portion. The groove shaped conductor connecting portion 26 has a conductor accommodating portion having an open end at one end inside, into which the inner conductor of one end of the cable CA is inserted from the open end. The conductor connecting portion 26 also has a rotatable clip 28 that turns the inner conductor of one end of the cable CA inserted into the conductor accommodating portion into a locked or unlocked state with respect to the conductor connecting portion 26. As shown in FIG. 1, in the case where it is in a locked state, the inner conductor of one end of the cable CA is sandwiched between the face of the conductor accommodating portion and an end 28P of the clip piece 28 serving as a contact piece capable of displacing elastically. The other end of the clip 28, serving as a operating piece, has an engagement portion 28*a* with both sides formed approximately into a T shape (refer to FIG. 10A). The other end of the clip 28, which includes the engagement portion 28*a*, is held in a locked state by the engagement of the engagement portion 28*a* and the hook-like portion 26K formed at the end of the contact-end-24-side of the conductor connecting portion 26. As a result, without the need for a soldering, caulking operation or the like, one end of the cable CA can be connected to the plug contact terminal 20 via a simple operation.

The conductor connecting portion 26 of the plug contact terminal 20 is arranged in the contact accommodating portion 14A of the contacting/sealing cylinder 14. At the conductor connecting portion 26, the nib portions 26J, respectively provided at both side walls forming the contact accommodating portion 14A, engage each of the notches 26S (refer to FIG. 1) of the oppositely disposed sidewall portions. Due to this the conductor connecting portion 26 is fixed in the contact accommodating portion 14A.

Figure 5:
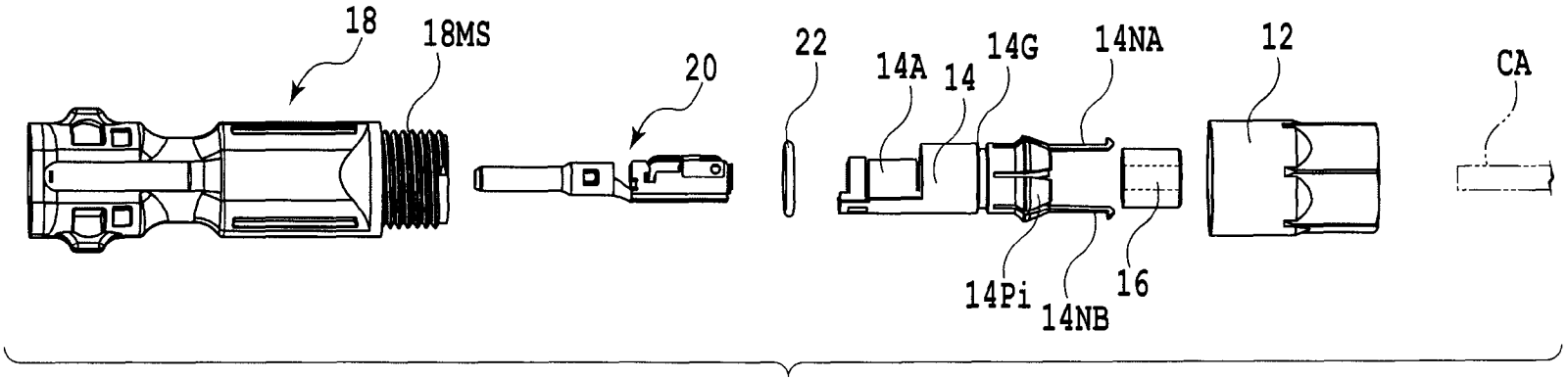
FIG. 5 is a front view of the disassembled plug connector shown in FIG. 3.

The contacting/sealing cylinder 14 is integrally formed from a resin material, for example, and as shown in FIG. 5, is configured to include a contact accommodating portion 14A that at one end receives the conductor connecting portion 26 of the plug contact terminal 20, and a plurality of pressing pieces 14Pi (i=1 to 6), which form a cylindrical shape at the other end and press the sealing tube 16, located therein, toward the outer surface of one end of the inserted cable CA.

The contact accommodating portion 14A is formed into a grooved shape and both ends along the axial direction are open. One of the ends of the contact accommodating portion 14A is in communication with the internal hole 14*a* (refer to FIG. 9) formed inside the plurality of pressing pieces 14Pi. Nib portions, which hold the above described conductor connecting portion 26, are oppositely formed at both walls that form both sides of the contact accommodating portion 14A.

The pressing pieces 14Pi are, for example, formed at 6 locations along a circumferential course, at fixed intervals. Each of the ends of the pressing pieces 14Pi is integrally formed onto a common cylinder. A groove 14G (refer to FIG. 5), into which the O ring 22 is inserted, is formed on the common cylinder. Because of this, undesirable penetration of liquid to the inside of the plug housing 18, through the female thread portion 12FS of the later described stepped pressure nut member 12 and the male thread portion 18MS of the plug housing 18, is avoided due to the O-ring 22.

Figure 9:
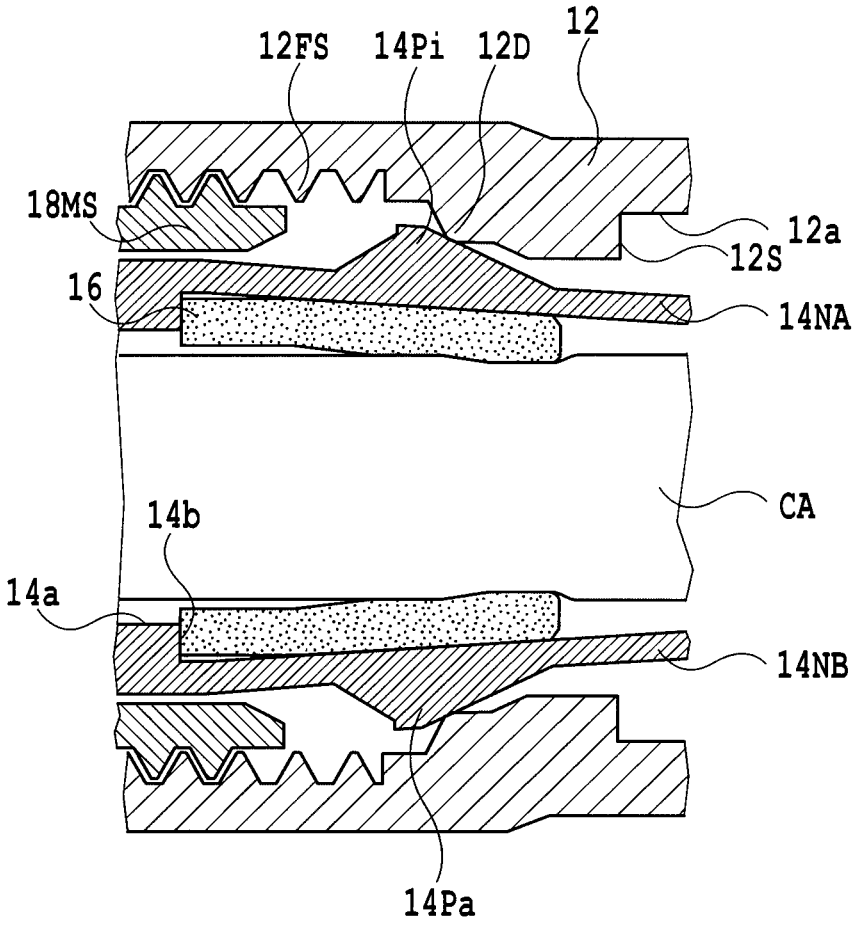
FIG. 9 is a partial cross sectional view to make available for explaining the operation of the contacting/sealing cylinder.

The other end of each pressing piece 14Pi, partially enlarged as shown in FIG. 9, has a protrusion 14Pa that projects towards the inner surface of the stepped pressure nut member 12 when the female thread portion 12FS of the stepped pressure nut member 12 is screwed onto the male thread portion 18MS of the plug housing 18. Adjacent pressing pieces 14Pi have crevices mutually formed between them such that the pressing pieces 14Pi become capable of elastic displacement. It should be noted that the number of pressing pieces 14Pi is not limited to the example; there may be 2 or more pieces, 5 or less pieces, or even 7 pieces or more, for example.

As partially enlarged and shown in FIG. 9, an annular concave portion 14*b*, into which the sealing tube 16 is mounted, is formed at the inner peripheries of the pressing pieces 14Pi.

Furthermore, a pair of engagement nibs, 14NA and 14NB, are integrally formed, respectively, at the front ends of the protrusions 14Pa of one pair of oppositely disposed pressing pieces 14Pi, among the plurality of pressing pieces 14Pi, such as to extend along the axial direction. The twin engagement nibs 14NA and 14NB are capable of elastic displacement, and are capable of contracting and separating with respect to each other. Thus, in the case where the pair of engagement nibs 14NA and 14NB is inserted into the hole 12*a* of later described stepped pressure nut member 12, as shown by FIG. 1, the pair of engagement nibs 14NA and 14NB is capable of movement with respect to the inner ridge of the hole 12*a*.

At that time, in the case where the front ends of the pair of engagement nibs 14NA and 14NB engage the step portion 12S at the end of the hole 12*a*, the operation of inserting, at once, one end of the cable CA into the hole of the contacting/sealing cylinder, becomes easy because there is no fear that the contacting/sealing cylinder 14 will fall off the stepped pressure nut member 12.

The inner diameter of the sealing tube 16, made out of a rubber-like material into a cylindrical shape for example, is configured to be slightly larger than the outer diameter of the cable CA, such that the outer perimeter of the cable CA is capable of being inserted. Also, the outer diameter of the sealing tube 16 is configured to be approximately the same as the diameter of the annular concave portion 14*b* of the above described contacting/sealing cylinder 14.

The stepped pressure nut member 12, which has hexagonal planes on its outer surface, has a through-hole 12*a* along a central axis, as shown in FIG. 1, and has a female thread portion 12FS at one end. The female thread portion 12FS has an inner diameter that is slightly larger than the inner diameter of the hole 12*a*, and is formed to face the inner surface of the hole 12*a*. A step height portion 12S is formed at the end of the female-thread-portion-12FS-side of the hole 12*a*. As shown in FIG. 9, an annular projection 12D, which presses the protrusions 14Pa of the plurality of pressing pieces 14Pi described above, is formed in the interval between the step 12S and an end of the female thread portion 12FS. Thus pressing of the pressing pieces 14Pi and the sealing tube 16 by the projection 12D becomes possible in conjunction with the motion of the female threaded portion 12FS being screwed onto the male threaded portion 18MS of the plug housing 18.

The plug housing 18 is molded of a resin material, for example, and at one end has a male threaded portion 18MS onto which the female threaded portion 12FS of the stepped pressure nut member 12 is screwed. The male threaded portion 18MS is formed on the outer perimeter of the plug housing such as to face the female threaded portion 12FS. A small diameter portion 18B, into which the distal end of the connection end 38B of the socket housing 38 of the later described socket connector 30 is inserted, and a large diameter portion 18E, into which the proximal end of the connection end 38 is inserted, are formed inside the other end of the plug housing. The contact end 24 of the plug contact terminal 20 projects along the axial direction into the small diameter portion 18B.

As shown in FIG. 1, a conductor connector housing section 18A, which houses the cylindrical portion of the above described contacting/sealing cylinder 14 and the conductor connecting portion 26 of the plug contact terminal 20, is formed at the inner side of the male threaded portion 18MS. A communication portion 18C is formed between the conductor connector housing section 18A and the small diameter portion 18B. A pair of locking nibs 38 NA and 38NB of the socket connector 30 are formed to respectively face to face with the insertion slits 18DA and 18DB. Holes 18*da* and 18*db* are respectively formed at the ends of the slits 18DA and 18DB. Thus when the socket connector 30 and the plug connector 10 are connected, the ends of the pair of locking nibs 38NA and 38NB are attached the border of the holes 18*da* and 18*db*, as shown by FIG. 2. In the case of pulling the socket connector 30 and the plug connector 10 apart, the ends of the pair of locking nibs 38NA and 38NB are separated from and become disengaged with respect to the border of the holes 18*da* and 18*db*, by way of the insertion of a given jig (not shown) into the holes 18*da* and 18*db*.

Figure 10A:
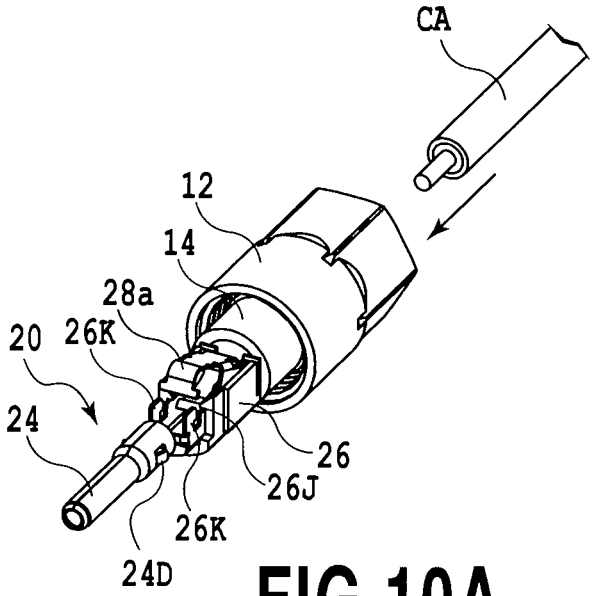
FIG. 10A and FIG. 10B are perspective views made available for explaining each step of the assembly of the plug connector.
Figure 10B:
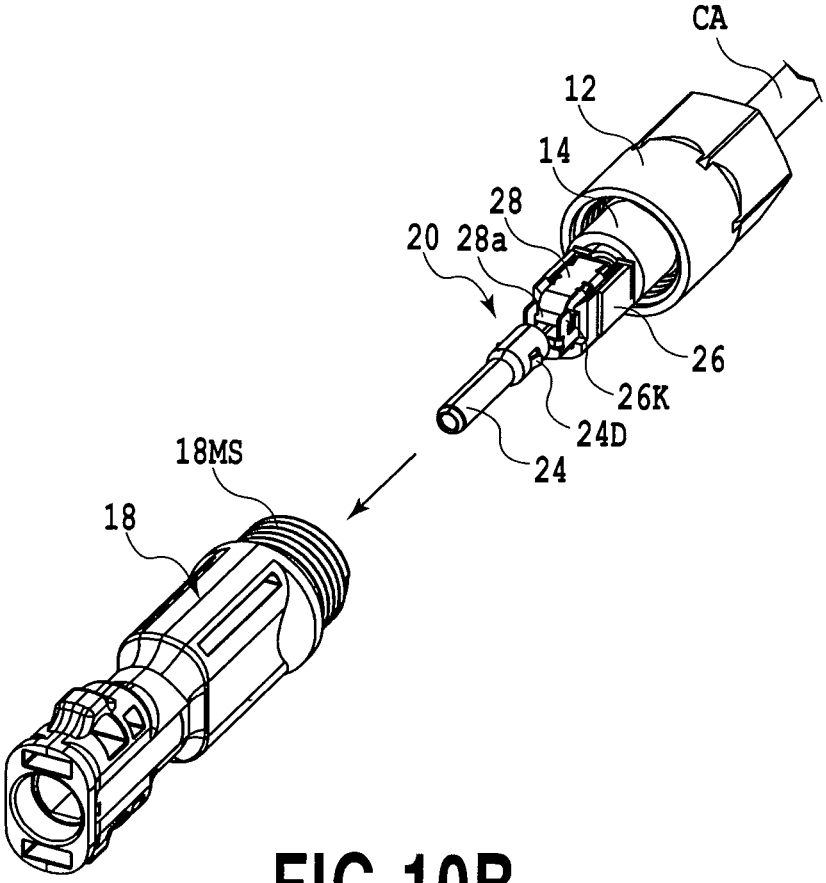

Regarding the above structure, when combining the plug contact terminal 20, which has an end of the cable CA connected to the conductor connecting portion 26 thereof, to the plug housing 18, the pair of engagement nibs 14NA and 14NB of the contacting/sealing cylinder 14, which has the sealing tube 16 mounted therein, are first inserted into the hole 12*a* of the stepped pressure nut member 12. Herewith the contacting/sealing cylinder 14 and the stepped pressure nut member 12 are combined, and are made one component. Next, as shown in FIG. 10A, the conductor connecting portion 26 of the plug contact terminal 20 is fixed to the contact accommodating portion 14A of the contacting/sealing cylinder 14. Then, along the direction denoted by the arrow shown in FIG. 10A, the inner conductor of one end of the cable CA is led from the plug-contact-terminal-20-side, through the hole 12*a* of the stepped pressure nut member 12, the hole of the sealing tube 16, and the hole 14*a* of the contacting/sealing cylinder 14, and after the inner conductor is inserted, with the clip piece 28 being unlocked, into the conductor connecting portion 26, the clip piece 28 is locked. FIG. 10A illustrates the unlocked state of the clip piece 28. Next, along the direction denoted by the arrow shown in FIG. 10B, with the cable CA in a grasped state, the plug contact terminal 20 connected to one end of the cable CA is inserted through the conductor connector housing unit 18A and the communication portion 18C of the plug housing 18. Herewith, as shown in FIG. 1, the contact end 24 of the plug contact terminal 20 is projected into the small diameter portion 18B. Next, the female threaded portion 12FS of the stepped pressure nut member 12 is screwed onto the male threaded portion 18MS of the plug housing 18, and the combination is completed. Herewith, as enlarged in FIG. 9, because the annular projection 12D at the inner perimeter of the stepped pressure nut member 12 exerts pressure on the protrusions 14Pa of each of the pressing pieces 14Pi of the contacting/sealing cylinder 14, the inner perimeter of the sealing tube 16 is made intimate contact with the outer perimeter of the cable CA, and the outer perimeter of the sealing tube 16 is made intimate contact with the inner surface forming the concave portion 14*b*. Thus by the sealing tube 16 it is possible to prevent outside liquid from undesirably making an entry via the outer perimeter of the cable CA inside the plug housing 18.

Figure 4:
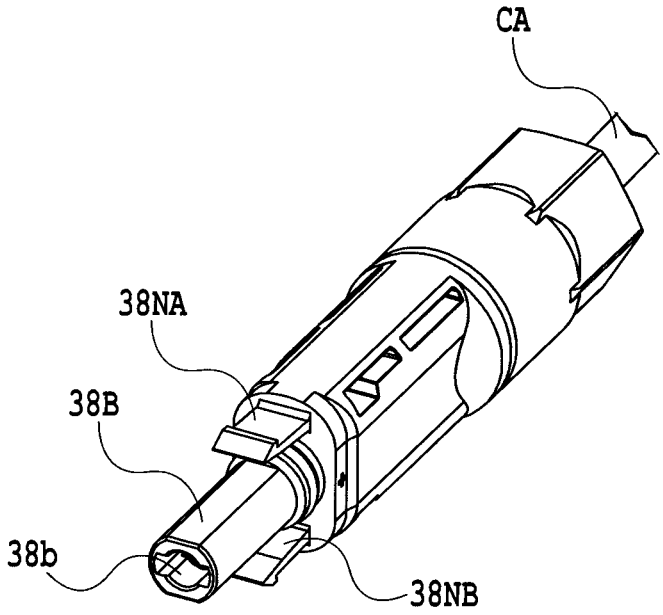
FIG. 4 is a perspective view illustrating a socket connector that makes up one part of the example shown in FIG. 1.
Figure 6:
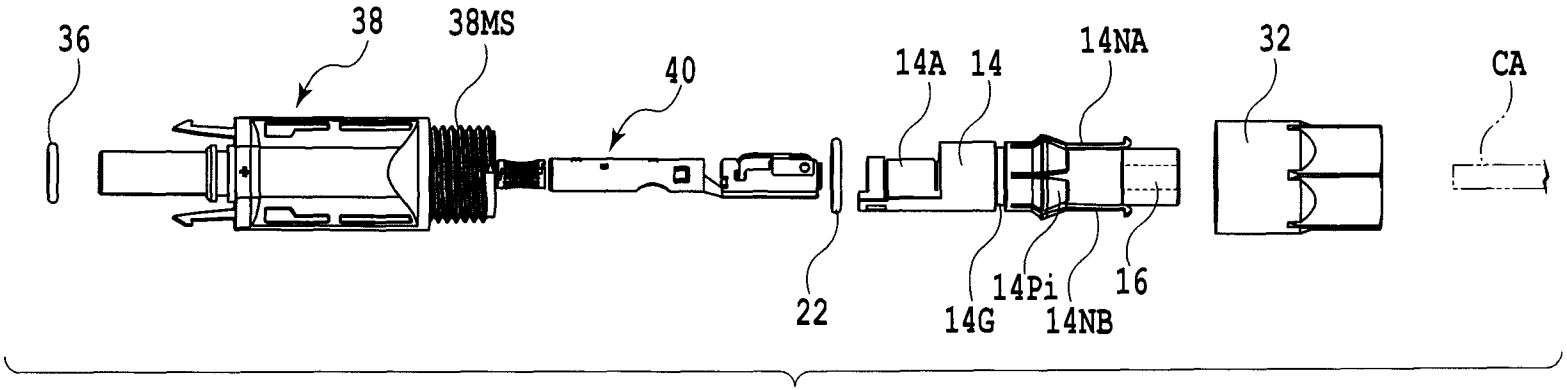
FIG. 6 is a front view of the disassembled socket connector shown in FIG. 4.

On the other hand, the socket connector 30, as shown in FIG. 4 and FIG. 6, is configured such that it includes as main components a socket contact terminal 40 (refer to FIGS. 7A, 7B, 8A and 8B) that connects to the internal conductor of one end of a cable CA, a cylindrical shaped cylinder 14 for contacting/sealing, which retains the socket contact terminal 40, a sealing tube 16 for sealing between the outer periphery of one end of the cable CA and the inner periphery of the contacting/sealing cylinder 14, a socket housing 38 that houses the socket contact terminal 40 and the contact/sealing cylinder 14 in which the sealing tube 16 is inserted into the inner part thereof, and a stepped pressure nut member 32 that has a female threaded portion 32FS, which is threaded into the male threaded portion 38MS of the socket housing 38, and which presses the pressing pieces 14Pi of the contact/sealing cylinder 14 towards the sealing tube 16.

The socket contact terminal 40, as shown in FIGS. 7A, 7B, 8A and 8B, is integrally formed by press working with thin metal sheet material, for example, and is configured to include a cylindrical contact end 44 having a hole 44*a* into which the cylindrical contact end 24 of the above described plug contact terminal 20 is fit into, and to include a conductor connecting portion 46 that selectively presses and connects the inner conductor of one end of the cable CA. A projection 44D, which engages a concave portion (unshown) formed on the communication portion 38C of the socket housing 38 described later, is formed on the outer periphery of the contact end 44.

Due to this, when the contact end 44 of the socket contact terminal 40 is inserted into the communication portion 38C its position with respect to the communication portion 38C of the socket contact terminal 40 is positioned by way of the projection 44D engaging in the concave portion.

A adhesion sleeve 34 is fit to the inner perimeter of the contact end 44.

Figure 7A:
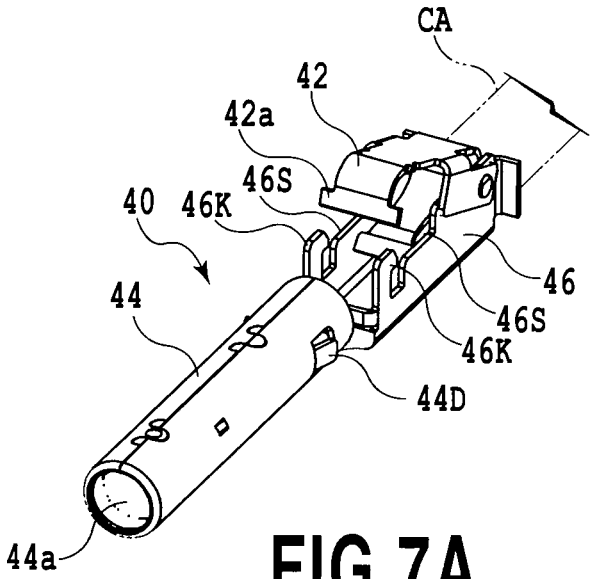
FIG. 7A is a perspective view illustrating the socket contact terminal in a state where the clip is unlocked.
Figure 7B:
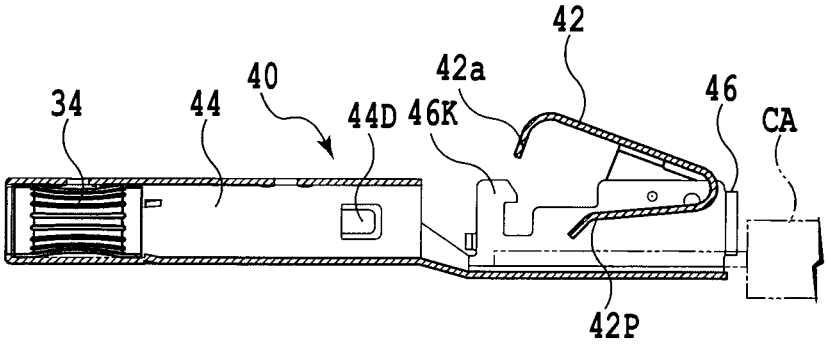
FIG. 7B is a cross sectional view along the central axis of FIG. 7A.
Figure 8A:
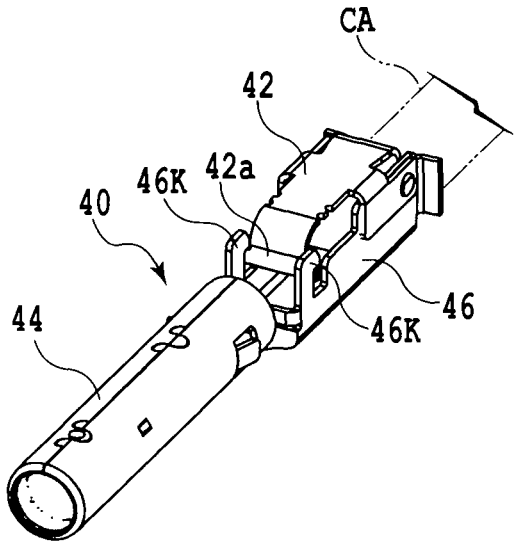
FIG. 8A is a perspective view illustrating the socket contact terminal in a state where the clip is locked.
Figure 8B:
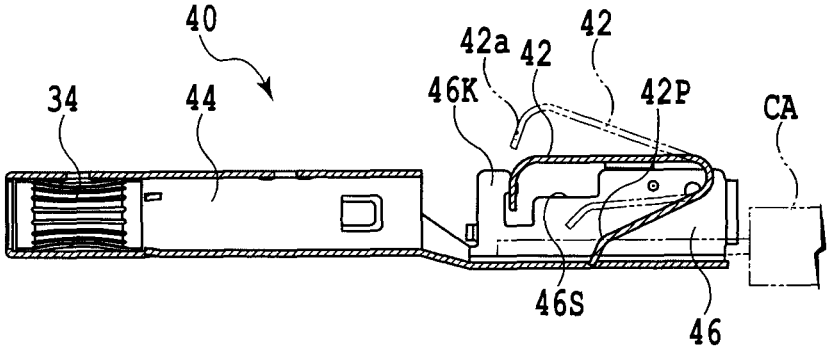
FIG. 8B is a cross sectional view along the central axis of FIG. 8A.

The groove shaped conductor connecting portion 46 has a conductor accommodating portion comprising an open end at one end inside, into which the inner conductor of one end of the cable CA is inserted from the open end. The conductor connecting portion 46 has a rotatable clip 42 that turns the inner conductor of one end of the cable CA inserted into the conductor accommodating portion into a locked or unlocked state with respect to the conductor connecting portion 46. As shown in FIGS. 8A and 8B, in the case where it is in a locked state, the inner conductor of one end of the cable CA is sandwiched by the face of the conductor accommodating portion and an end 42P of the clip piece 42 serving as a contact piece capable of displacing elastically. The other end of the clip 42, serving as an operating piece, has an engagement portion 42*a* with both sides formed approximately into a T shape. The other end 42P of the clip 42, which includes the engagement portion 42*a*, is held in a locked state by the engagement of the engagement portion 42*a* and the hook-like portion 46K formed at the end of the contact-end-44-side of the conductor connecting portion 46. As a result, without the need for a soldering, caulking operation or the like, one end of the cable CA can be connected to the socket contact terminal 40. It should be noted that FIGS. 7A and 7B illustrate the unlocked state of the clip piece 42.

The conductor connecting portion 46 of the socket contact terminal 40 is arranged at the contact accommodating portion 14A of the contacting/sealing cylinder 14. At the conductor connecting portion 46, as shown in FIG. 1, the nib portions 46J, respectively provided at both side walls forming the contact accommodating portion 14A, engage each of the notches 46S of the oppositely disposed sidewall portions. Herewith the conductor connecting portion 46 is fixed in the contact accommodating portion 14A.

The stepped pressure nut member 32, which is molded of a resin material, for example, and has hexagonal planes on its outer surface, has a through-hole 32*a* along a central axis, as shown in FIG. 1, and has a female thread portion 32FS at one end. The female thread portion 32FS has an inner diameter that is slightly larger than the inner diameter of the hole 32*a*, and is formed to face the inner surface of the hole 32*a*. A step height portion 32S is formed at the end of the female-thread-portion-32FS-side of the hole 32*a*. As shown in FIG. 1, an annular projection 32D, which presses the protrusions 14Pa of the plurality of pressing pieces 14Pi described above, is formed the in the interval between the step height 32S and an end of the female thread portion 32FS. Thus pressing of the pressing pieces 14Pi and the sealing tube 16 by the projection 32D becomes possible in conjunction with the motion of the female thread portion 32FS being screwed onto male thread portion 38MS of the socket housing 38.

The plug housing 38 is made from a resin material, for example, and at one end has a male threaded portion 38MS onto which the female threaded portion 32FS of the stepped pressure nut member 32 is screwed, as shown in FIG. 1. The male threaded portion 38MS is formed on the outer perimeter of the socket housing 38 such as to face to face with the female threaded portion 32FS. The socket housing 38 has a connection end 38B at its other end. The connection end 38B projects along the axial direction from the other end toward the plug housing 18 of the plug connector 10. In the case of connecting the socket connector 30 to the plug connector 10, the connection end 38B is inserted into the small diameter portion 18B of the plug housing 18 of the plug connector 10 described above. The base of the connection end 38B is also inserted into the large diameter portion 18E of the plug housing 18. A groove, into which the O-ring 36 is laid, is formed on the outside surface of the base. Herewith penetration of liquid from the outside to the inside, through the end face of socket housing 38 touching at the end face of the plug housing 18, is prevented by the O-ring 36.

In the vicinity of the O-ring 36 a pair of locking nibs 38NA and 38NB are formed roughly parallel to the connection end 38B. As described above, the pair of locking nibs 38NA and 38NB are inserted into the slits 18DA and 18DB of the plug housing 18.

A hole, in which the contact end 44 of the socket contact terminal 40 is inserted, is formed inside the connection end 38B. A hole 38*b*, through which the contact end 24 of the plug contact terminal 20 passes through, is also formed at one end of the hole.

A conductor connector accommodating portion 38A, which accommodates the cylindrical portion of the above described contacting/sealing cylinder 14 and the conductor connecting portion 46 of the socket contact terminal 40, is formed at the inner side of the male threaded portion 38MS. A communication portion 38C is formed between the conductor connector accommodating portion 38A and the hole of the connection end 38B.

Figure 11:
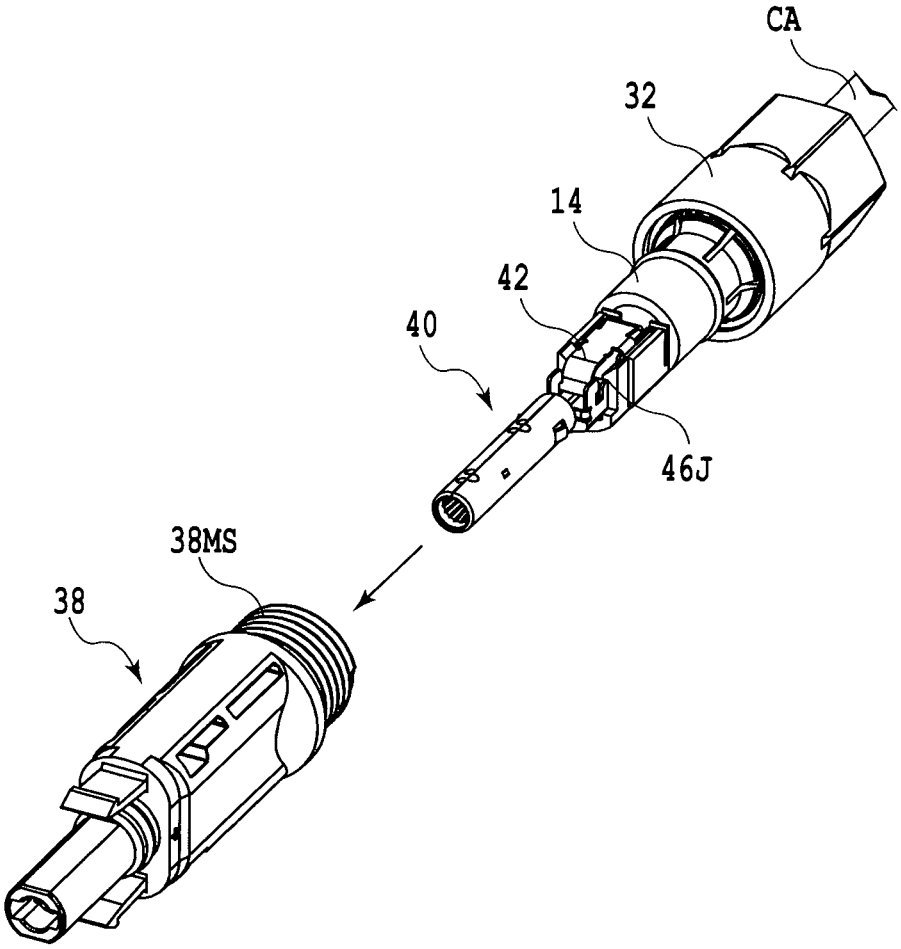
FIG. 11 is a perspective view made available for explaining the steps in assembling the socket connector.

Regarding the above structure, when combining the socket contact terminal 40, which has an end of the cable CA connected to the conductor connecting portion 46 thereof, to the socket housing 38, the pair of engagement nibs 14NA and 14NB of the contacting/sealing cylinder 14, which has the sealing tube 16 mounted thereon, are first inserted into the hole 32*a* of the stepped pressure nut member 32. Herewith the contacting/sealing cylinder 14 and the stepped pressure nut member 32 are combined, and are made one component. Next, as shown in FIG. 11, the conductor connecting portion 46 of the socket contact terminal 40 is fixed to the contact accommodating portion 14A of the contacting/sealing cylinder 14. Next, along the direction denoted by the arrow shown in FIG. 11, the internal conductor of one end of the cable CA is lead from the socket-contact-terminal-40-side, through the hole 32*a* of the stepped pressure nut member 32, the hole of the sealing tube 16, and the hole 14*a* of the contacting/sealing cylinder 14, and after internal conductor is inserted, with the clip piece 42 being unlocked, into the conductor connecting portion 46, the clip piece 42 is locked. Next, along the direction denoted by the arrow shown in FIG. 11, with the cable CA in a grasped state, the socket contact terminal 40 connected to one end of the cable CA is inserted through the conductor connector accommodating portion 38A and the communication portion 38C of the socket housing 38. Herewith, as shown in FIG. 1, the contact end 44 of the plug contact terminal 40 is projected into the inner periphery of the connection end 38B.

Next, the female threaded portion 32FS of the stepped pressure nut member 32 is screwed onto the male threaded portion 38MS of the socket housing 38, and the combination is completed. Herewith, because the annular projection 32D at the inner perimeter of the stepped pressure nut member 32 exerts pressure on the protrusions 14Pa of each of the pressing pieces 14Pi of the contacting/sealing cylinder 14, the inner perimeter of the sealing tube 16 is made intimate contact with the outer perimeter of the cable CA, and the outer perimeter of the sealing tube 16 coheres to the inner surface forming the concave portion 14*b*. Thus by the sealing tube 16 it is possible to prevent outside liquid from undesirably making an entry through the outer perimeter of the cable CA inside the socket housing 38.

Figure 12:
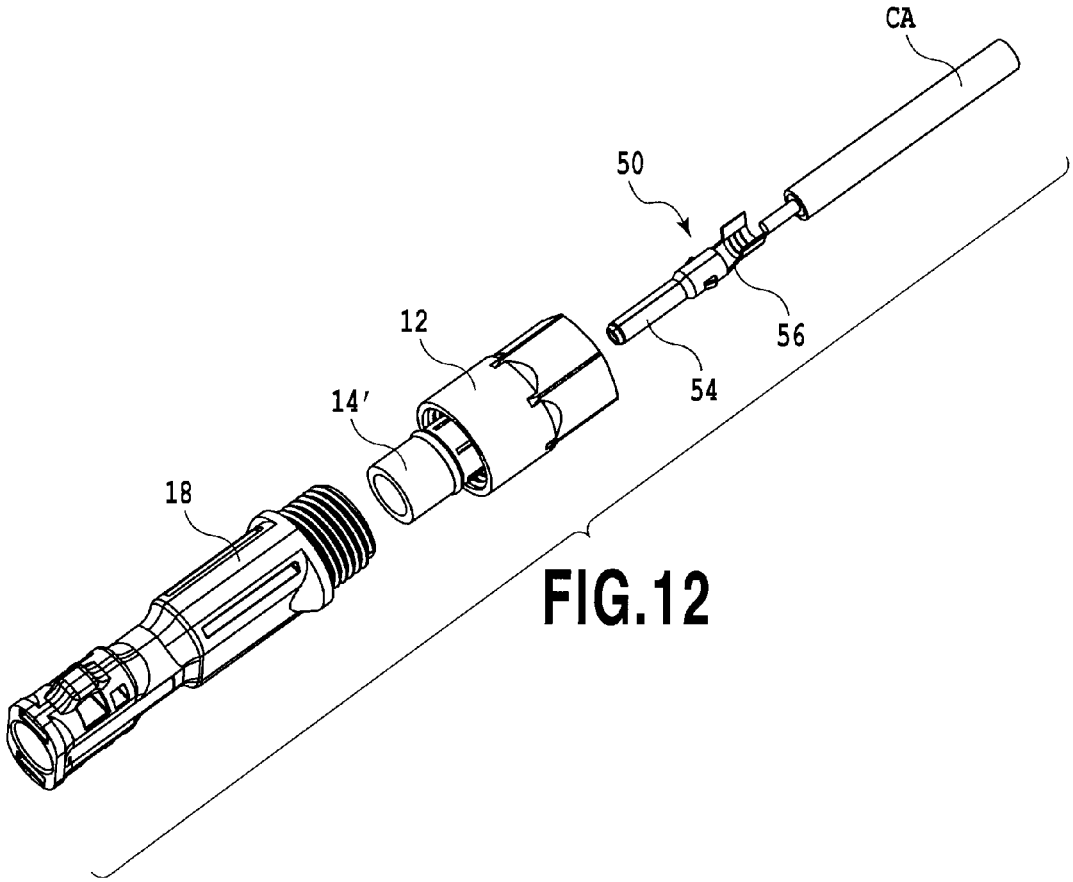
FIG. 12 is a perspective view illustrating a disassembled plug connector provided with another example of the plug contact terminal used in the example shown in FIG. 1.

It should be noted that while in the example described above the socket contact terminal 40 and the plug contact terminal 20 have, respectively, a clip piece 42 and a clip piece 28, they are not limited to such cases; for example, as shown in FIG. 12, a configuration that the plug contact terminal 50 is provided with a conductor connecting portion 56, whereby the plug contact terminal 50 is connected by way of crimping of the inner conductor of an end of the cable CA, and that is provided with a contact end 54, is also acceptable. In a case such as this, in FIG. 12, the sealing cylinder 14', which is analogous to the contacting/sealing cylinder 14 described above, is, for example, integrally formed from a resin material into a cylindrical shape, and structured to include a plurality of pressing pieces that presses a sealing tube 16, disposed therein, towards the outer surface of one end of the inserted cable CA. That is, the sealing cylinder 14' is a structure that renders unnecessary a contact accommodating portion 14A such as that of the contacting/sealing cylinder 14. A pair of engagement nibs is integrally formed, respectively, at the front ends of the protrusions of a pair of oppositely disposed pressing pieces, among the plurality of pressing pieces of the sealing cylinder 14', such as to extend along the axial direction. It should be noted that in FIG. 12 elements that are the same as the elements of the example shown at FIG. 5 are marked with the same symbols, and duplicative explanation has been omitted. In a similar vein, although omitted from the figures, a configuration, which the socket contact terminal is provided with a conductor connecting portion wherein the socket contact terminal is connected via the crimping of the inner conductor of an end of the cable CA, and a contact end is also acceptable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A waterproof structure for a cable connector comprising:

a housing that detachably houses a contact terminal connected to an end of a cable having an outer periphery;

a sealing cylinder that is disposed in said housing and holds, inside a plurality of pressing pieces, a sealing tube mounted on the outer periphery of the cable inserted into said housing;

a pressing member that presses the plurality of pressing pieces of said sealing cylinder, and said sealing tube, toward the outer periphery of said cable inside said housing, when the contact terminal connected to the end of said cable is housed in said housing, said pressing member having an inner periphery;

wherein engagement nibs, respectively formed on at least one pair of pressing pieces among the plurality of pressing pieces of said sealing cylinder, movably engage said pressing member; and wherein protrusions, which protrude toward the inner periphery of said pressing member, are formed on each pressing piece of said sealing cylinder, and projections, which press said protrusions of each of the pressing pieces, are formed on the inner periphery of said pressing member.

2. A plug connector comprising the waterproof structure of a cable connector of claim 1.

3. A socket connector comprising the waterproof structure of a cable connector of claim 1.

4. A cable connector comprising the socket connector of claim 3 and a plug connector having:

a plug housing that detachably houses a plug contact terminal, which is connected to an end of a cable and has a rod-shaped contact end;

a sealing tube mounted on the outer periphery of the cable inserted into said plug housing;

a sealing cylinder that is disposed in said plug housing and holds said sealing tube inside a plurality of pressing pieces; and a pressing member that presses the plurality of pressing pieces of said sealing cylinder, and said sealing tube, toward the outer periphery of said cable inside said plug housing, when the plug contact terminal connected to the end of said cable is housed in said plug housing;

wherein engagement nibs, respectively formed on at least one pair of pressing pieces among the plurality of pressing pieces of said sealing cylinder, movably engage said pressing member.

5. A waterproof structure for a cable connector comprising:

a housing that detachably houses a contact terminal connected to an end of a cable having an outer periphery;

a sealing cylinder that is disposed in said housing and holds, inside a plurality of pressing pieces, a sealing tube mounted on the outer periphery of the cable inserted into said housing;

a pressing member that presses the plurality of pressing pieces of said sealing cylinder, and said sealing tube, toward the outer periphery of said cable inside said housing, when the contact terminal connected to the end of said cable is housed in said housing; wherein engagement nibs, respectively formed on at least one pair of pressing pieces among the plurality of pressing pieces of said sealing cylinder, movably engage said pressing member; and wherein said sealing cylinder has a contact accommodating portion that accommodates said contact terminal, and wherein said contact terminal is provided with a conductor connecting portion in which an inner conductor of said cable is disposed and a clip piece that is rotational movably disposed on said conductor connecting portion, and which takes a locked position that holds the inner conductor of said cable in relation to said conductor connecting portion, and which takes an unlocked position that releases the inner conductor of said cable in relation to said conductor connecting portion.

6. A plug connector comprising the waterproof structure for a cable connector of claim 5.

7. A socket connector comprising the waterproof structure for a cable connector of claim 5.

8. A cable connector comprising the socket connector of claim 7 and a plug connector having:

a plug housing that detachably houses a plug contact terminal, which is connected to an end of a cable and has a rod-shaped contact end;

a sealing tube mounted on the outer periphery of the cable inserted into said plug housing;

a sealing cylinder that is disposed in said plug housing and holds said sealing tube inside a plurality of pressing pieces; and a pressing member that presses the plurality of pressing pieces of said sealing cylinder, and said sealing tube, toward the outer periphery of said cable inside said plug housing, when the plug contact terminal connected to the end of said cable is housed in said plug housing;

wherein engagement nibs, respectively formed on at least one pair of pressing pieces among the plurality of pressing pieces of said sealing cylinder, movably engage said pressing member.

* * * * *